US005885630A

United States Patent [19]

Zurawski et al.

[11] Patent Number: 5,885,630

[45] **Date of Patent: *Mar. 23, 1999**

[54] MULTIFLAVOR GUM PACKAGING SYSTEM USING A VOLATILE-FLAVOR ADSORBER

[75] Inventors: Joseph G. Zurawski, Evanston; William T. Boyd, Aurora, both of Ill.

[73] Assignee: Wm. Wrigley Jr. Company, Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 717,159

[22] Filed: Sep. 20, 1996

[51] Int. Cl.[6] ..... B65D 85/00; B65D 81/00; B65B 25/00; B65B 55/00

[52] U.S. Cl. ..... 426/5; 426/118; 426/119; 426/120; 426/124; 426/395; 426/398; 426/415

[58] Field of Search ..... 426/5, 124, 119, 426/120, 118, 395, 398, 415; 206/204, 205, 213.1, 524.4, 800

[56] References Cited

U.S. PATENT DOCUMENTS

| | | | |
|---|---|---|---|
| 1,193,423 | 8/1916 | Pryor | 206/800 |
| 1,532,831 | 4/1925 | Mastin | 206/204 |
| 2,263,191 | 11/1941 | Saladin et al. | 206/800 |
| 2,380,367 | 7/1945 | Ranney | 206/800 |
| 2,548,168 | 4/1951 | Luce | 426/124 |
| 2,674,509 | 4/1954 | Barnett | 426/124 |
| 2,825,651 | 3/1958 | Loo et al. | 426/124 |
| 2,988,209 | 6/1961 | Parrilla | 206/800 |
| 3,820,309 | 6/1974 | Cullen et al. | 206/524.4 |
| 4,287,995 | 9/1981 | Moriya | 426/124 |
| 4,421,235 | 12/1983 | Moriya | 426/124 |
| 4,636,392 | 1/1987 | Toshitsugu | 426/124 |
| 4,657,133 | 4/1987 | Komatsu et al. | 206/204 |
| 4,897,273 | 1/1990 | Kotaki et al. | 426/124 |
| 5,043,177 | 8/1991 | Chimel et al. . | |
| 5,370,219 | 12/1994 | Violett | 206/800 |
| 5,407,442 | 4/1995 | Karapasha . | |

FOREIGN PATENT DOCUMENTS

| | | | |
|---|---|---|---|
| 55-135542 | 10/1980 | Japan | 426/124 |
| 8701546 | 2/1989 | Netherlands | 426/124 |
| 2255555 | 11/1992 | United Kingdom | 426/124 |

OTHER PUBLICATIONS

Multisorb Technologies, Inc. Technical Data Sheet, Apr. 25, 1996 (1 page).

Multiform Desiccants, Inc., "MiniPax™ Sorbent Packets," Brochure, Jul. 1995 (2 pages).

Desiccare, Inc., Brochure (1 page) (No Date).

*Primary Examiner*—Steven Weinstein

*Attorney, Agent, or Firm*—Steven P. Shurtz; Brinks Hofer Gilson & Lione

[57] ABSTRACT

A chewing gum packaging system comprising a container that contains a volatile-flavor adsorber and at least two flavors of chewing gum. The volatile-flavor adsorber prevents the flavors of the gums from cross-contaminating each other by adsorbing the volatile flavor components from each gum while the gum is stored in the package.

21 Claims, 3 Drawing Sheets

MULTIFLAVOR GUM PACKAGING SYSTEM USING A VOLATILE-FLAVOR ADSORBER

BACKGROUND OF THE INVENTION

The present invention relates to chewing gum packaging systems. This invention allows two or more flavors of chewing gum to be packaged in a single multi-unit container without cross-contamination of the flavors. Specifically, a volatile-flavor adsorber is added to each container. The adsorber prevents the volatile flavors of the chewing gums from cross-contaminating each other by adsorbing the volatile components from each flavor.

Chewing gum is normally divided and shaped into individual pieces, such as sticks, tablets, balls or the like. The individual pieces are individually wrapped and placed in a multi-piece package for retail sale. Ordinarily, the individually wrapped or multi-piece packages of chewing gum are further parcelled in boxes, bags, canisters, or other containers for retail display. Moreover, the multi-unit containers are generally packed into larger receptacles for shipment to the distributors and retailers.

The usual practice is to pack only a single flavor of the gum into each of this multi-level packaging system to simplify manufacturing and distribution. Packaging single flavors also prevents cross-contamination by volatile flavor components. However, there are many instances where it would be desirable to combine packages of different flavor chewing gums into a common multi-unit container (box, bag, canister, etc.).

In the case of retail-display units, a multi-flavor packaging system provides smaller retailers with display units which maximize the variety of chewing gums and minimizes inventory and display space requirements. In addition, there are instances where the retail-display units are sold in their multi-unit configuration at the retail level. In such instances, the consumer often prefers a variety of different flavor chewing gums in each container.

In the case of shipping receptacles, a multi-flavor packaging system allows smaller shipments of different flavor chew gums to be packaged together. This negates the need to ship each flavor in a separate package.

A drawback for the multi-flavor packaging of chewing gum is that volatile flavor components from the gums tend to contaminate each other. This cross-contamination produces a muddled, inappropriate flavor perception, often called an off-note, when the chewing gum is consumed. Such off-notes are unacceptable in terms of quality control and consumer acceptance. This problem is particularly acute when more volatile flavors such as fruit flavors contaminate mint flavored products.

SUMMARY OF THE INVENTION

The inventors have developed a system of greatly reducing or eliminating the cross-contamination of flavors between different flavor chewing gums that are contained in a common package. The system comprises adding a volatile-flavor adsorber to a container that contains at least two different flavors of chewing gum. The adsorber adsorbs the volatile flavors before they can contaminate the co-contained, different-flavor products.

Figure 1:
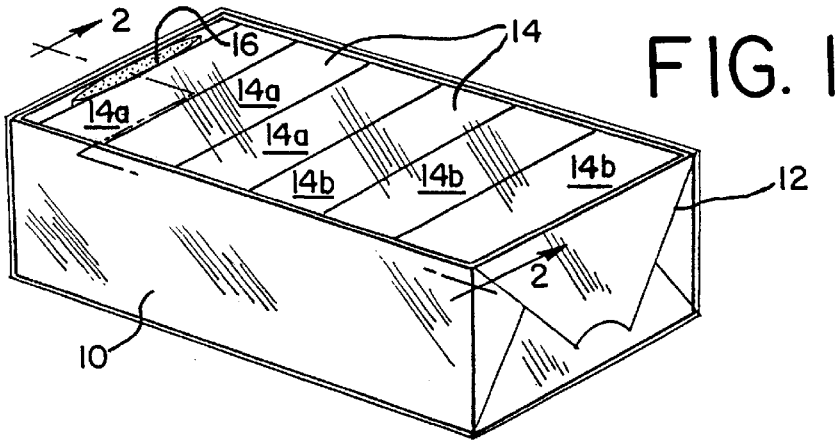
FIG. 1 is a perspective view of a paperboard tray, overwrapped in plastic that contains eighteen packages of gum, and a pouch of adsorbent inserted at one end of the tray.

DETAILED DESCRIPTION OF THE DRAWINGS AND THE PREFERRED EMBODIMENT OF THE INVENTION

In the context of this invention, chewing gum refers to both chewing gum and bubble gum. As used herein, the term "container" includes any multi-unit package, including retail-sale packages as well as shipping receptacles such as boxes, cartons, canisters, and bags. Bags include preformed bags as well as sheets of wrapping material that overwrap multiple-pieces of chewing gum or chewing gum packages, and are sealed to create a package.

Chewing gum manufacturers and distributors generally do not package more than one flavor of chewing gum within a single container, because the volatile flavor components from the gums tend to contaminate each other. The cross-contamination can produce off-notes that are unacceptable in terms of quality control and consumer acceptance. Cross-contamination sometimes is not a problem when the flavors are compatible, such as when the different flavors are all of the mint variety. However, when the more volatile flavors such as fruit flavors mix with mint flavored products, the cross-contamination is particularly troublesome.

To overcome the disadvantage of flavor cross-contamination in multi-flavor packaging, a volatile-flavor adsorber is either packaged with the gum, or incorporated into the container. The volatile-flavor adsorber adsorbs the volatile-flavor components from the chewing gum, and prevents cross-contamination of the flavors.

Chewing gum is normally formed as sheets, sticks, blocks, pellets, tablets, and the like. Sometimes the gum has a coating, such as a hard candy or sugar coating. However, most of the time the gum is wrapped in a fairly gas permeable wrapper, such as a close fitting, but unsealed paper/foil laminate with a paper band around it.

For the purpose of retail sale, the chewing gum pieces are often packaged in multi-piece packages. Some common retail packages include multiples of individually wrapped pieces, overwrapped in foil, paper, plastic or wax-paper. Other retail packages include multiple pieces of gum that are not individually wrapped, but are segregated by paper bands.

The coated gums are often not individually wrapped, but are packaged in bags or in paper, plastic or metal dispensers. Sometimes, the gum pieces are packaged in plastic blister packs with a paper, foil or plastic backing, which are in-turn contained in a paperboard sleeve.

For shipping purposes, containers such as boxes, cartons, pouches and envelopes are often used. On the other hand, retail display or retail sale containers can include paperboard boxes, paperboard trays sealed with overwrap or shrink wrap, cartons, canisters, bags, blister packs and the like.

Plastics for the bag or the overwrap include low density polyethylenes (LDPE), high density polyethylenes (HDPE), polyvinyl chlorides, polyester terapthalates, polypropylenes and the like, as well as coextrudates and laminates thereof. These plastics may also be coated with, for example, vinylidene chloride homopolymers (SARAN™), metals, acrylates, silicon dioxide and the like. Acrylic coated polypropylene is a presently preferred plastic for bags and overwraps.

Canisters are made from plastic, glass, metal, and the like. They include dispensers, jars, and the like. Plastic is presently preferred because the consumer prefers a transparent, light-weight material.

The following figures illustrate, but do not limit, the variety of multi-piece packages, and the variety of forms of adsorbent that are encompassed by the present invention.

As shown in FIGS. 1–4, 6 and 8, a container may contain multiple packages of gum. Each package of gum may contain a single flavor of gum (or multiple flavors that are compatible with each other), but the container contains packages of at least two different flavored chewing gum.

Figure 2:
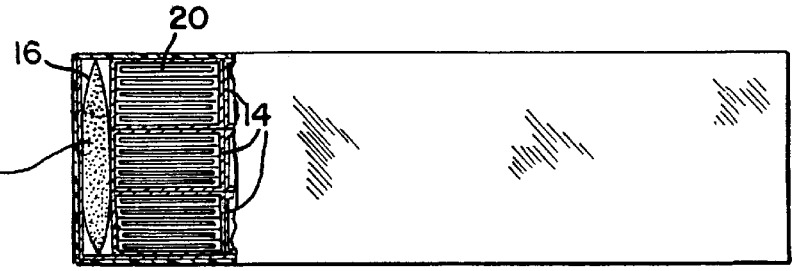
FIG. 2 is a partial cross sectional view taken along line 2—2 of FIG. 1 showing the adsorbent powder in the pouch, the packages of gum and the pieces of gum in each package.

For example, FIGS. 1 and 2 illustrate a paperboard tray 10 in a plastic overwrap 12. Tray 10 contains three layers of packages of gum 14. Each package 14 is a conventional package that contains five sticks of gum 20, all of the same flavor. Generally, each stick of gum 20 is wrapped in a paper/foil laminate and surrounded by a paper band. However, tray 10 contains at least two different flavors of gum. For example, packages 14*a* could contain fruit flavored chewing gum, while packages 14*b* contain mint flavored chewing gum. A pouch of adsorbent 16 is inserted at one end of the tray. As shown in the FIG. 2 cross-sectional view, the adsorbent is preferably in the form of a powder 18 contained in pouch 16.

Figure 3:
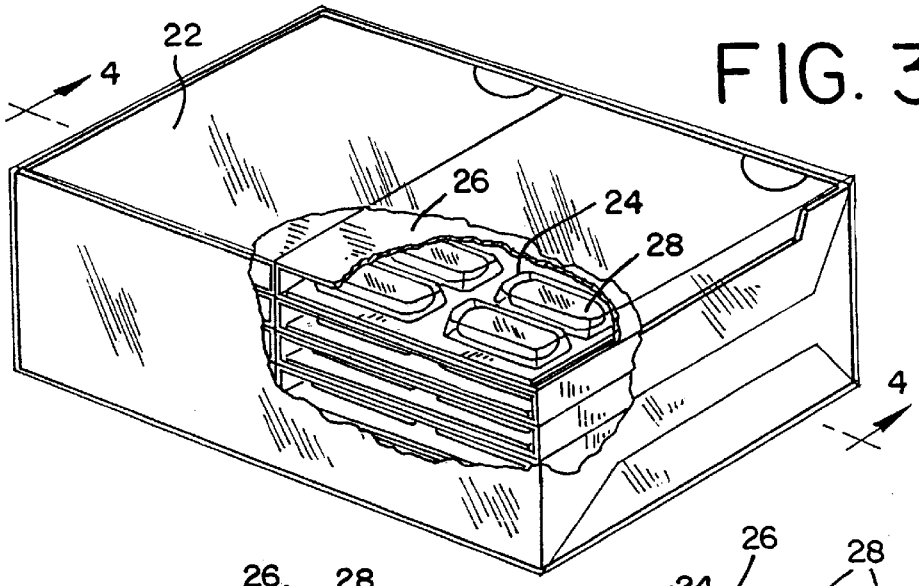
FIG. 3 is a partial cross sectional view of a paperboard tray where the retail units are blister packs in paperboard sleeves.
Figure 4:
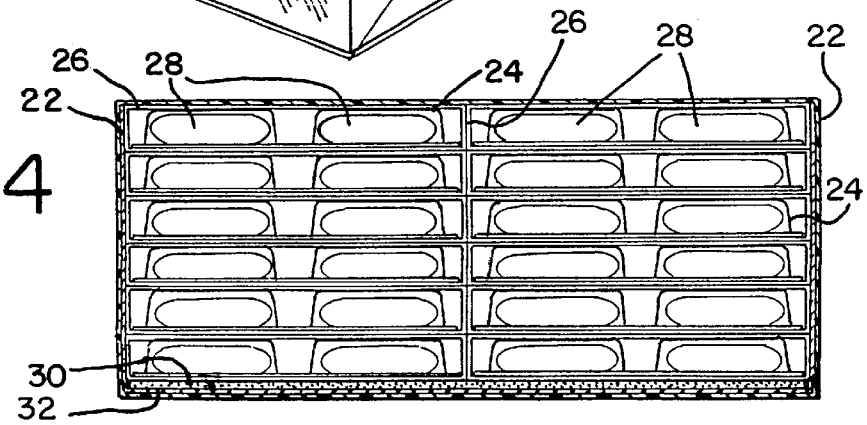
FIG. 4 is a cross sectional view taken along line 4—4 of FIG. 3 showing the blister packs in the paperboard sleeves, and a layer of adsorbent glued to the bottom of the paperboard tray.

FIGS. 3 and 4 illustrate a plastic overwrapped paperboard tray 22 where the retail units are blister packs 24 of individual pieces of gum 28 in paperboard sleeves 26. In this embodiment, the adsorbent is in the form of a layer of adsorbent 30 glued to the bottom 32 of the paperboard tray 22.

Figure 6:
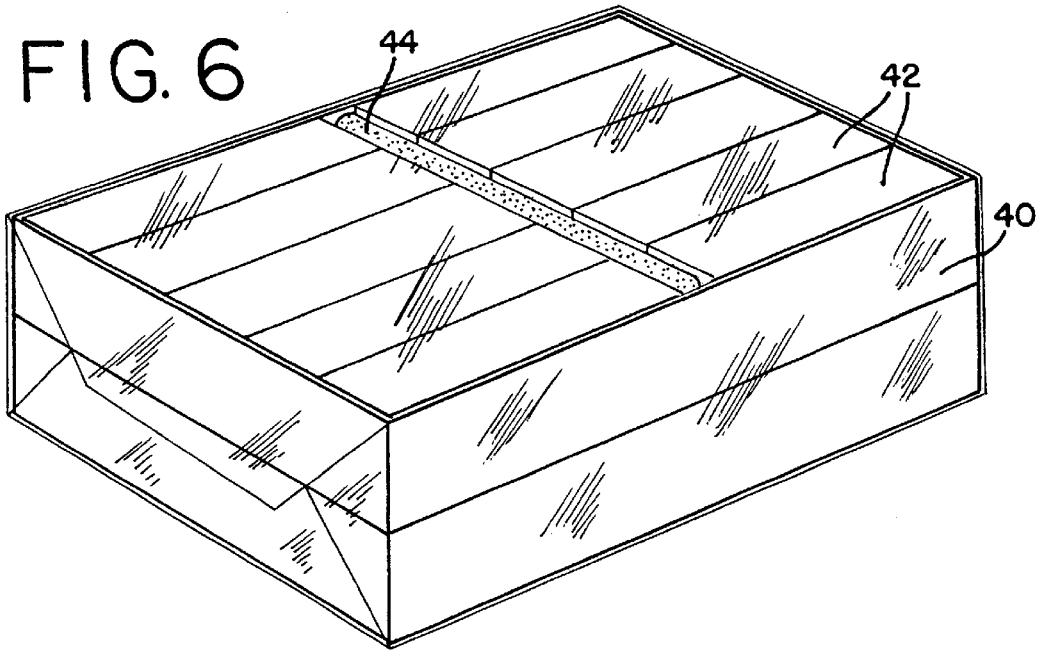
FIG. 6 is a perspective view of a paperboard tray, overwrapped in plastic that contains twenty packages of gum, and a sheet of adsorbent inserted between the columns of gum packages.

FIG. 6 illustrates a plastic overwrapped paperboard tray 40 that contains packages of gum 42. In this embodiment the adsorbent is in the form of a fused sheet 44 inserted between the columns of gum packages.

Figure 8:
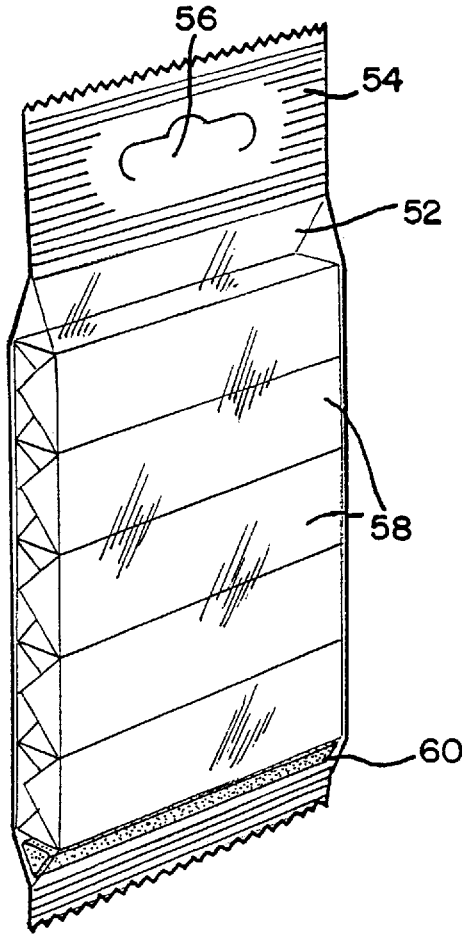
FIG. 8 is a perspective view of a clear plastic bag that forms a hang pouch with a hang hole in the top, the bag containing five packages of gum and a triangular rod of adsorbent at the bottom of the bag.

FIG. 8 illustrates a clear plastic bag that forms a hang pouch 52 with its top portion fused to form a hang top 54 having a hang hole 56. Bag 52 contains five packages of gum 58. Here, the adsorbent is a fused triangular rod of adsorbent 60 at the bottom of the bag. As an alternative embodiment, the hang top can be a header card attached to the top of the bag, with the hang hole in the header card.

Figure 5:
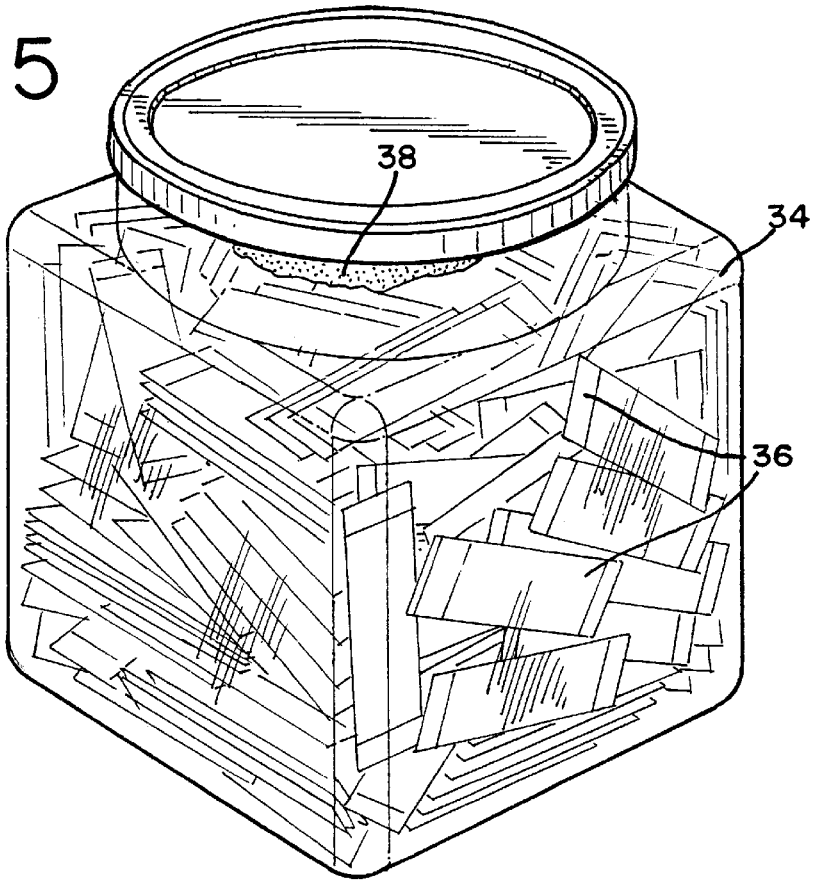
FIG. 5 is a perspective view of a clear plastic container that contains individually wrapped pieces of gum and a pouch of adsorbent that is attached to the lid.
Figure 7:
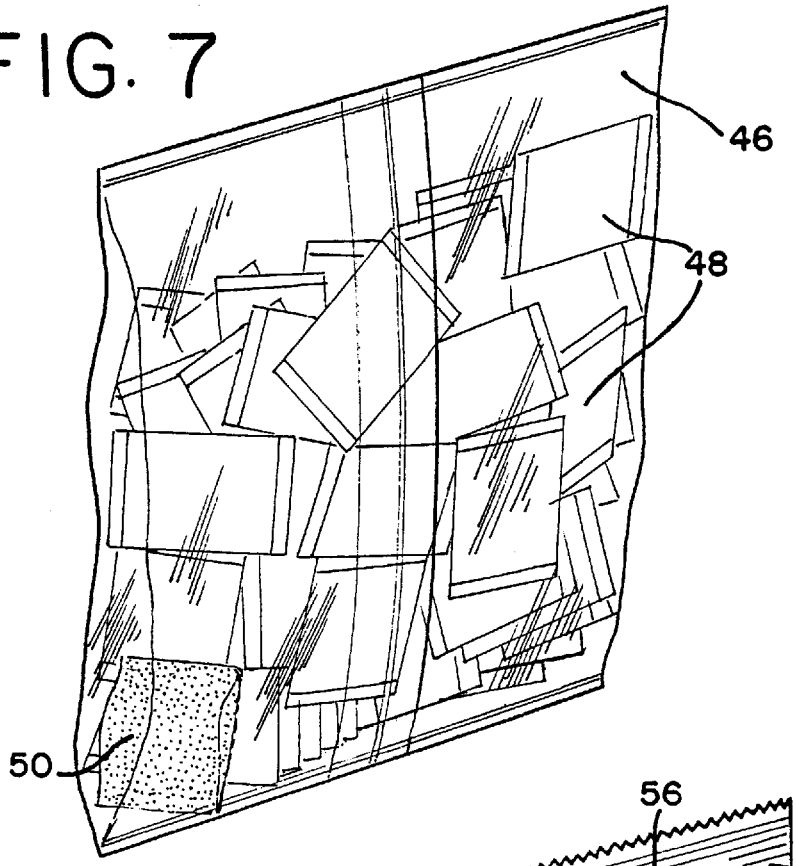
FIG. 7 is a perspective view of a clear plastic bag that contains individually wrapped pieces of gum and adsorbent contained in a pouch which is placed in the bag.

FIGS. 5 and 7 illustrates containers that contain pieces of gum that are individually wrapped. In such containers, each piece may constitute a different flavor of chewing gum, although there will normally be multiple pieces of each of several flavors in each container. FIG. 5 illustrates a clear plastic cannister 34 that contains individually wrapped pieces of gum 36 and a pouch of adsorbent 38 that is attached to the lid. FIG. 7 illustrates a clear plastic bag 46 that contains individually wrapped pieces of gum 48 and a pouch of powdered adsorbent 50 within the bag.

Examples of volatile-flavor adsorbing components usable in the present invention include activated carbon, zeolite, vermiculite, sodium bicarbonate, molecular sieves and the like. Of these, activated carbon is presently preferred.

As noted with respect to FIGS. 1 and 2, the volatile-flavor adsorber 18 is preferably in a powder form to maximize the surface area of the adsorber. The powdered adsorber 18 is contained in a gas permeable packet, sachet, or pouch (hereinafter "pouch") such as pouches 16, 38 or 50. The pouch is then placed or attached in the multi-unit container with the different-flavor chewing gums. The pouch prevents the migration of loose particles of volatile-flavor adsorbent throughout the container. Loose particles of adsorbent, while still within the scope of the present invention, would give an untidy appearance to the displayed product.

Pouch 16, 38 or 50 that contains the adsorbent is preferably formed from a gas permeable sheet material or fabric. While the material will not allow particles of adsorbent to escape, its pores or passages will allow air and volatiles to freely pass into the pouch and contact the adsorbent. A preferred material for this purpose is made of uncoated spun-bonded polyolefin fibers, sold under the trademark TYVEK™. However, other materials can form suitable pouches.

Other ways to accomplish the objective of preventing loose adsorbent from migrating around the container include incorporating the adsorbent into one or more of the materials that constitute the container, attaching the adsorbent to the container with an adhesive as in FIG. 3 and FIG. 5, or fusing the adsorbent into a single briquette. An advantage of a fused briquette of adsorbent is that it can take the form of blocks, sheets 44, rods 60, spheres, pellets, wafers, chips, raschig rings or other structures to maximize space utilization with its intended container. In some cases such as in FIGS. 4–5, the adsorbent is preferably attached to the container.

The quantity of adsorbent material used will depend on many variables such as the size of the container, the quantity of product contained, the effectiveness of the volatile-flavor adsorbent material, the effectiveness of the individual package barrier materials, the effectiveness of the multi-unit container barrier, the relative volatility (or propensity to transfer) of the flavors, duration of storage and the relative susceptibility of the products to noticeable cross-contamination. The variety of flavors of gum can include mint, cinnamon, fruit and bubble gum.

Exposure to humidity may also affect the amount of volatile-flavor adsorbent needed. This is due to the fact that the volatile-flavor adsorbent may also adsorb atmospheric moisture. Thus higher expected humidities and less effective package barriers within the container will increase the required quantity of adsorbent. Well sealed packages may decrease the quantity of adsorbent required. As a general guideline, two grams of activated carbon in a TYVEK™ sachet is appropriate for a one pound box of gum overwrapped with acrylic coated polypropylene.

EXAMPLES

Two samples of each of the following were prepared:

Control A—Positive Control

A standard eighteen pack paperboard tray, as shown in FIG. 1, was loaded with six five-stick packages each of Wrigley's Spearmint, Doublemint and Juicy Fruit gum. The product was arranged three layers deep with each layer composed of two packages of Doublemint, two packages of Wrigley's Spearmint and two packages of Juicy Fruit, in that order. The tray was overwrapped with acrylic coated polypropylene and heat sealed with envelope folds.

Control B—Negative Control

Control A was duplicated except that all eighteen packages were Wrigley's Spearmint.

Control C—Non-Overwrapped Control

Control A was duplicated except that the over wrap was not applied.

Example 1—Inventive—Two Gram

Control A was duplicated except that two grams of activated carbon in a TYVEK™ sachet was placed between the end of the tray and the Doublemint packages.

Example 2—Inventive—Five Gram

Example 1 was duplicated except that five grams of activated carbon was used.

Testing

Samples of each control and example (Controls A, B & C and Examples 1 & 2) were stored at two conditions—85° F./70% RH and 85° F./35% RH—for ten weeks. After storage, the samples were unwrapped and blind evaluated by trained sensory panelists. The results, which are summarized in TABLE 1, demonstrate that the volatile-flavor adsorbent prevented flavor cross-contamination in the mixed flavor container.

TABLE 1

| CROSS-CONTAMINATION | | |
|---|---|---|
| | 85° F./70% RH[1] | 85° F./35% RH |
| Control A | | |
| Spearmint | fruit notes | fruit notes |
| Doublemint | fruit notes | fruit notes |
| Juicy Fruit | off notes | off notes |
| Control B (Spearmint) | none | none |
| Control C (no overwrap) | none[2] | none[2] |
| Example 1 (2 g. Carbon) | none[3] | none |
| Example 2 (5 g. Carbon) | none[4] | none[4] |

[1]RH = relative humidity.
[2]The panelists found a "less clean" flavor, although it was not considered defective.
[3]The panelists found a texture difference between the two relative humidities.
[4]The panelists found less texture difference between the two relative humidities than with Example 1 which used less activated carbon.

It should be appreciated that the systems and methods of the present invention are capable of being incorporated in the form of a variety of embodiments, only a few of which have been illustrated and described above. The invention may be embodied in other forms without departing from its spirit or essential characteristics. The described embodiments are to be considered in all respects only as illustrative and not restrictive, and the scope of the invention, therefore, is indicated by the appended claims rather than by the foregoing description. All changes which come within the meaning and range of equivalency of the claims are to be embraced within their scope.

We claim:

1. A chewing gum packaging system comprising:

a) a closed container that contains both b) a volatile flavor adsorber selected from the group consisting of activated carbon, zeolite, vermiculite, sodium bicarbonate and molecular sieves; and c) at least two pieces of chewing gum, each piece being individually wrapped, wherein at least one piece of said at least two pieces comprises one flavor and wherein at least one other piece of the at least two pieces comprises another, different flavor from the flavor of the at least one piece, and wherein said one flavor of chewing gum comprises a first flavor selected from the group consisting of mint, cinnamon, fruit and bubble gum, and said another different flavor of chewing gum comprises a second flavor selected from the group consisting of mint, cinnamon, fruit and bubble gum;

d) the volatile-flavor adsorber being present in an amount and positioned such that the volatile-flavor adsorber is capable of adsorbing volatile flavor components emitted from each of said pieces of chewing gum before the adsorbed emitted volatile flavor components can contaminate the co-packaged different flavor chewing gum, thereby reducing cross-contamination of the flavors between said one flavor chewing gum, and said different flavor chewing gum in the closed container.

2. The system of claim 1 wherein the container is a tray and further comprises either a plastic, paper, wax-paper or foil overwrap.

3. The system of claim 1 wherein the container is a box.

4. The system of claim 1 wherein the container comprises either a metal, plastic or glass canister.

5. The system of claim 1 wherein the container comprises a plastic bag.

6. The system of claim 5 wherein the bag comprises a strip pouch having a hang tag.

7. The system of claim 1 wherein the adsorber comprises at least one fused unit.

8. The system of claim 7 wherein the fused unit is in a form selected from the group consisting of spheres, pellets, raschig rings, sheets, blocks, wafers, chips and rods.

9. The system of claim 1 wherein the adsorber is in a gas permeable pouch.

10. The system of claim 9 wherein the pouch is made from uncoated spun-bonded polyolefin fibers.

11. The system of claim 1 wherein the adsorber is attached to the container.

12. The system of claim 11 wherein the adsorber comprises at least one fused unit.

13. The system of claim 1 wherein the adsorber is incorporated in the material which forms the container.

14. The system of claim 1 wherein the adsorber is contained in a gas permeable pouch which is attached to the container.

15. The system of claim 1 wherein the volatile-flavor adsorber is activated carbon.

16. The system of claim 1 wherein there are a plurality of individually wrapped pieces of said one flavor of chewing gum and a plurality of individually wrapped pieces of said different flavor of chewing gum, and the plurality of individually wrapped pieces of the chewing gum of said one flavor are packaged together in a first multi-piece package within the container and the plurality of individually wrapped pieces of the chewing gum of said different flavor are packaged together in a second multi-piece package within the container.

17. A chewing gum packaging system comprising:

a) a paperboard tray wrapped in either plastic, paper, wax-paper or foil so as to be closed;

b) a pouch of activated carbon in the closed tray; and c) at least two pieces of chewing gum in the closed tray each piece being individually wrapped, wherein at least one piece of said at least two pieces comprises one flavor and wherein at least one other piece of the at least two pieces comprises another, different flavor from the flavor of the at least one piece, and wherein said one flavor of chewing gum comprises a first flavor selected from the group consisting of mint, cinnamon, fruit and bubble gum, and said another different flavor of chewing gum comprises a second flavor selected from the group consisting of mint, cinnamon, fruit and bubble gum;

d) the pouch of activated carbon being positioned and containing an amount of activated carbon such that the activated carbon is capable of adsorbing volatile flavor components emitted from each of said pieces of chewing gum before the adsorbed emitted volatile flavor components can contaminate the co-packaged different flavor chewing gum, thereby reducing cross-contamination of flavors between said one flavor chewing gum and said different flavor chewing gum in the wrapped paperboard tray.

18. The system of claim 17 wherein the system contains multiple wrapped pieces of each of three flavors of chewing gum, each wrapped piece of chewing gum being contained within at least one multi-piece package within the paper board tray.

19. The system of claim 17 wherein said one flavor is selected from the group consisting of fruit flavors and said different flavor is selected from the group consisting of mint flavors.

20. A method of packaging chewing gum comprising the steps of packaging both a volatile-flavor adsorber selected from the group consisting of activated carbon, zeolite, vermiculite, sodium bicarbonate and molecular sieves and at least two pieces of individually chewing gum wrapped into a container, and then closing said container containing both said adsorber and said at least two pieces of chewing gum, wherein at least one piece of said at least two pieces comprises one flavor and wherein at least one otherpiece of the at least two pieces comprises another, different flavor from the flavor of the at least one piece, and wherein said one flavor of chewing gum comprises a first flavor selected from the group consisting of mint, cinnamon, fruit and bubble gum, and said another different flavor of chewing gum comprises a second flavor selected from the group consisting of mint, cinnamon, fruit and bubble gum, and wherein the volatile-flavor adsorber is present in an amount and positioned such that the volatile-flavor adsorber is capable of adsorbing volatile flavor components emitted from each of said pieces of chewing gum before the adsorbed emitted volatile flavor components can contaminate the co-packaged different flavor chewing gum, thereby reducing cross-contamination of flavors between said one flavor chewing gum and said different flavor chewing gum in the closed container.

21. A method of packaging chewing gum comprising the steps of:

a) packaging in a paperboard tray i) at least two pieces of chewing gum, each piece being individually wrapped, wherein at least one piece of said at least two pieces comprises one flavor and wherein at least one other piece of the at least two pieces comprises another, different flavor from the flavor of the at least one piece, and wherein said one flavor of chewing gum comprises a first flavor selected from the group consisting of mint, cinnamon, fruit and bubble gum and said another different flavor of chewing gum comprises a second flavor selected from the group consisting of mint, cinnamon, fruit and bubble gum; and ii) activated carbon that is contained in a gas-permeable pouch, the activated carbon being present in an amount and the pouch being positioned such that the activated carbon is capable of adsorbing volatile flavor components emitted from each of said pieces of chewing gum before the adsorbed emitted volatile flavor components can contaminate the co-packaged different flavor chewing gum, thereby reducing cross-contaminate flavors between said one flavor chewing gum and said different flavor chewing gum when the tray and chewing gum are closed in a wrapper; and b) wrapping the tray and said at least two pieces of chewing gum and said pouch containing said activated carbon in either plastic, paper, wax-paper or foil to close the tray.

* * * * *

UNITED STATES PATENT AND TRADEMARK OFFICE

CERTIFICATE OF CORRECTION

PATENT NO. : 5,885,630

DATED : March 23, 1999

INVENTOR(S) : Joseph G. Zurawski et al.

It is certified that error appears in the above-identified patent and that said Letters Patent is hereby corrected as shown below:

In the Claims

In claim 20, line 5, please change "chewing gum wrapped" to --wrapped chewing gum--.

In claim 21, line 24, please change "cross-contaminate flavors" to --cross-contamination of flavors--.

Signed and Sealed this

Fifteenth Day of May, 2001

Nicholas P. Godici

*Attest:*

NICHOLAS P. GODICI

*Attesting Officer*

*Acting Director of the United States Patent and Trademark Office*